United States Patent [19]

Graham

[11] 4,442,169

[45] Apr. 10, 1984

[54] MULTIPLE COATED CUTTING TOOL AND METHOD FOR PRODUCING SAME

[75] Inventor: Donald E. Graham, St. Clair Shores, Mich.

[73] Assignee: General Electric Company, Schnectady, N.Y.

[21] Appl. No.: 343,545

[22] Filed: Jan. 28, 1982

[51] Int. Cl.[3] ..... B32B 15/04

[52] U.S. Cl. ..... 428/332; 148/6.3; 148/16.5; 148/16.6; 427/249; 427/253; 427/287; 428/336; 428/472; 428/698; 428/701

[58] Field of Search ..... 428/332, 336, 457, 548, 428/217, 472, 701, 698; 427/249, 253, 250, 287; 148/6.3, 16.6, 16.5

[56] References Cited

U.S. PATENT DOCUMENTS

| | | | |
|---|---|---|---|
| 3,717,496 | 2/1973 | Kiefler et al. | 428/457 |
| 3,787,223 | 1/1974 | Reedy, Jr. | 148/6.3 |
| 3,836,392 | 9/1974 | Lux et al. | 148/6.3 |
| 3,837,896 | 9/1974 | Lindstrom et al. | 428/336 |
| 3,854,991 | 12/1974 | Hale | 148/16.16 X |
| 3,874,900 | 4/1975 | Post et al. | 148/16.5 |
| 3,955,038 | 5/1976 | Lindstrom et al. | 428/457 |
| 3,964,937 | 6/1976 | Post et al. | 148/16.6 X |
| 4,035,541 | 7/1977 | Smith et al. | 428/217 |
| 4,101,703 | 7/1978 | Schintlmeister | 428/457 |
| 4,150,195 | 4/1979 | Tobioka et al. | 428/548 |
| 4,162,338 | 7/1979 | Schintlmeister | 427/249 |
| 4,268,582 | 5/1981 | Hale et al. | 427/249 X |

*Primary Examiner*—Thomas J. Herbert, Jr.

*Attorney, Agent, or Firm*—Hedman, Gibson, Costigan & Hoare

[57] ABSTRACT

An article of manufacture adapted for use as a cutting tool is provided with an aluminum oxide coated substrate having layers of TiN and/or TiC deposited thereon, whereby the beneficial characteristics of the TiN, TiC and $Al_2O_3$ coatings are provided simultaneously for such cutting tool. The TiN/TiC outer layers are strongly bonded to the $Al_2O_3$ layer by means of an intermediate TiO layer. The process for producing such insert is also disclosed.

13 Claims, No Drawings

MULTIPLE COATED CUTTING TOOL AND METHOD FOR PRODUCING SAME

BACKGROUND OF THE INVENTION

The present invention is directed to cemented carbide cutting inserts having chemical vapor deposited coatings thereon for increasing the wear resistance of the cutting inserts.

Use of chemical vapor deposited (CVD) coatings on a carbide cutting tool, such as WC-Co or WC-TiC-TaC-Co cutting tools to increase the wear resistance of such cutting tools is well known. The improved performance is a result of chemical stability, refractory characteristics, hardness and a low coefficient of friction inherent in such coatings.

TiN, TiC and $Al_2O_3$ are examples of such coatings. Each of these coatings exhibits the above described properties in varying degrees and ranges such that no one coating, by itself, performs optimally over the wide range of cutting conditions employed by industry. For example, $Al_2O_3$ coatings are superior to the other coatings at high cutting speeds where high temperatures are encountered, because of the very high chemical stability and low thermal conductivity which are properties of the ceramic. On the other hand, at very low speeds where metal buildup often causes tool failure, there are indications that TiN coatings are superior to others because of their low coefficient of friction. Further, the combination of hardness and chemical stability inherent in TiC makes it the optimum coating over a very broad range of intermediate speeds. Clearly, a cutting insert having the properties of two or more of such coatings would provide a highly useful tool capable of operating over a wide range of conditions.

A straightforward approach to the foregoing problem would be to provide a multi-layer coating on the cemented carbide cutting tool, the coating consisting of two or more of the above described coatings. However, the major difficulty in producing such a cutting tool is in obtaining sufficient adherency between coating layers, especially between the ceramic $Al_2O_3$ and the other coatings.

Various prior art cutting tools employ adjacent layers of $Al_2O_3$ and TiN or TiC on a cemented carbide substrate. Two such tools are disclosed in U.S. Pat. Nos. 3,837,896 and 3,955,038 both on Lindstrom et al. Disclosed therein are cutting tools comprised of a cemented carbide substrate and a thin coating layer of $Al_2O_3$. A diffusion barrier layer is stated to be required between the $Al_2O_3$ layer and the carbide substrate due to the harmful catalyzing effect in the formation and growth of the oxide layer due to Co and/or C in the carbide substrate. Such barrier layer may consist of nitrides or carbides of titanium.

Another insert disclosed in U.S. Pat. No. 4,150,195 to Tobioka et al employs a multi-layer coating deposited upon a carbide substrate. The multi-layer coating may include aluminum oxide as the most exterior layer, titanium carbonitride for the most interior coating layer, and titanium oxycarbonitride as an intermediate layer between the aluminum oxide and titanium carbonitride layers. The stated use of the intermediate layer of titanium oxycarbonitride is to increase the adhesive strength of the multi-layer coating.

None of the above cutting tools employ such multi-layer coatings for the purpose of providing the beneficial operating characteristics of each of the individual coating layers. That is, the prior art cutting inserts having an exterior layer of $Al_2O_3$ are designed to provide the cutting characteristics of the $Al_2O_3$ coated insert only, the underlying coating layers being provided merely as barriers between the oxide layer and the carbide substrate.

A novel coating procedure has now been discovered which allows the secure bonding of TiC, and/or TiN onto an $Al_2O_3$ coated carbide cutting tool, thereby providing TiC and/or TiN as exterior coating surfaces on top of an $Al_2O_3$ interior coating surface. Such a cutting tool exhibits the beneficial characteristics of TiC, TiN and $Al_2O_3$ in combination.

In accordance with the invention, a thin titanium oxide layer is disposed between the ceramic and the TiN and/or TiC coating, the titanium oxide layer functioning to increase the adherency between the ceramic and other coatings.

SUMMARY OF THE INVENTION

According to a first aspect of the invention, an article of manufacture comprises (i) A substrate having aluminum oxide on at least portions of the surface thereof, the aluminum oxide forming a first surface;

(ii) An intermediate layer of an oxide of titanium adjacent at least a portion of the first surface; and (iii) An outer layer of at least one of titanium nitride, titanium carbide and titanium carbonitride adjacent at least a portion of the intermediate layer.

The substrate may be either a cemented carbide substrate coated with aluminum oxide or an aluminum base solid ceramic. The intermediate layer contains TiO and is less than or equal to approximately 1 micron in thickness. The outer layer may include sub-layers of titanium nitride and titanium carbide, the titanium carbide sub-layer being disposed between and adjacent to the titanium nitride sub-layer and intermediate layer.

In accordance with a second aspect of the invention, a process for coating at least portions of a substrate having a aluminum oxide on at least portions of the surface thereof with an outer layer of at least one of titanium carbide, titanium nitride and titanium carbonitride, includes depositing a layer of $TiO_2$ on the substrate adjacent the aluminum oxide. The $TiO_2$ is reduced to form a TiO intermediate layer onto which the outer layer is deposited.

DETAILED DESCRIPTION OF THE INVENTION

Briefly, an $Al_2O_3$ coated cutting tool insert, such as Carboloy Grade 570, is exposed to a gaseous mixture of hydrogen, titanium tetrachloride ($TiCl_4$) and $CO_2$ at a temperature around 1050°–1100° C. Preliminary analysis suggests that the oxide which forms during this step is $TiO_2$. The temperature is then lowered in an atmosphere of hydrogen to the temperature required for the deposition of TiC or TiN. At this lower temperature, the tool is then exposed to an atmosphere of gaseous $TiCl_4$ and hydrogen. This step, possibly together with the subsequent deposition of the TiC or TiN, results in the transformation of the $TiO_2$ to a combination of TiO and $TiO_2$ or TiO and $Ti_2O_3$. A strongly adherent coating of TiN or TiC can then be produced by exposing the tool to gaseous mixtures of hydrogen, titanium tetrachloride and nitrogen, or hydrogen, titanium tetrachloride and methane, respectively. Since TiN and TiC can be easily bonded to each other, it is also possible to obtain a tri-layer coating consisting of $Al_2O_3$, TiC and TiN. The resulting structure is provided with exterior layers of TiN and/or TiC strongly bonded to an interior layer of $Al_2O_3$.

More specifically, an $Al_2O_3$ coated carbide cutting tool insert or $Al_2O_3$ base solid ceramic is placed inside a standard CVD furnace held at a temperature of about 1050° C. A gaseous mixture of hydrogen and titanium tetrachloride is passed over the surface of the insert for up to five minutes. Titanium, obtained by the reaction $$TiCl_4+2H_2 \rightarrow Ti+4HCl \quad (1)$$

will "activate" the $Al_2O_3$ surface, perhaps by reacting with the oxygen in the $Al_2O_3$ to form TiO or $TiO_2$.

Next, up to 15% by volume of $CO_2$ along with hydrogen and titanium tetrachloride is introduced into the furnace to form a thin layer, less than or equal to one micron, of $TiO_2$ according to the reaction.

$$TiCl_4+2CO_2+2H_2 \rightarrow TiO_2+2CO+4HCl. \quad (2)$$

This step takes from 1–35 minutes, longer exposure times yielding greater $TiO_2$ thicknesses.

The $TiO_2$ is subsequently reduced to TiO by lowering the temperature to about 1000° C., turning off the $CO_2$ and passing only hydrogen and titanium tetrachloride over the surface, yielding the reaction $$TiO_2+TiCl_4+2H_2 \rightarrow 2TiO+4HCl. \quad (3)$$

This step takes up to 30 minutes depending on the amount of $TiO_2$ present.

A final layer of TiN, TiC or TiCN, or a combination of any of these, can then be deposited in a standard fashion by introducing nitrogen, methane, or both, respectively, along with the hydrogen and titanium tetrachloride. The result of this process is a multi-layered coated product containing TiN or TiC, or both, on an aluminum oxide coated insert or an aluminum oxide base solid ceramic.

EXAMPLE

Coating a substrate with TiC using an intermediate layer of TiO was done in a laboratory chemical vapor deposition furnace having a reactor chamber constructed of steel. The substrate was an aluminum oxide-coated WC-TiC-TaC-Co cemented carbide (Carboloy Grade 570). The substrate was first cleaned inside the furnace by flowing hydrogen gas over the substrate, which was heated to 1100° C., at a flow rate of 400 ml/min. for 10 minutes. Subsequently a gas mixture of 10% $CO_2$, 3% $TiCl_4$, and 87% $H_2$ at a flow rate of approximately 450 ml/min. was used to deposit a titanium oxide which was believed to be $TiO_2$. The temperature was held at 1100° C. and 35 minutes were allowed for this step. The titanium oxide was then partially reduced by flowing a gas mixture of 3% $TiCl_4$ and 97% $H_2$ over the insert for 10 minutes at a temperature of 1035° C.

A TiC coating was then deposited at 1035° C. by introducing a gas mixture of 3% $CH_4$, 3% $TiCl_4$, and 94% $H_2$, for 50 minutes at a flow rate of about 450 ml/min. All of the above steps were accomplished at atmospheric pressure.

After coating, the adhesion of the TiC layer was determined by scratching it with a 4 kg loaded diamond. The TiC did not spall and, in fact, rode over the top of the TiC layer. When a TiC coating of identical thickness was deposited directly on an aluminum oxide-coated insert (Carboloy Grade 570) without a titanium oxide interlayer, the TiC coating was nonadherent. The coating spalled badly, not only when scratched with a 4 kg loaded diamond but also when scratched with a 2 kg loaded diamond.

When the TiC-coated product having the titanium oxide interlayer was examined metallographically, it was found that the interlayer was yellow, consistent with the presence of TiO, and ½–1 micron thick. The TiC coating was 4 microns thick. It may be found that some of the $TiO_2$ has not been fully reduced to TiO during reaction (3). However, as long as TiO exists adjacent to the TiN, TiC or TiCN, and between the $Al_2O_3$ and the $TiO_2$, adhesion will not be decreased.

Many variations will suggest themselves to those skilled in this art in light of the above detailed description. All such obvious variations are within the full intended scope of the invention as defined by the following claims.

What is claimed is:

1. An article comprising:
   (i) a cemented carbide or aluminum base solid ceramic substrate having aluminum oxide on at least portions of the surface thereof, said aluminum oxide forming a first surface;
   (ii) an intermediate layer of an oxide of titanium adjacent at least a portion of said first surface; and
   (iii) an outer layer of at least one of titanium nitride, titanium carbide and titanium carbonitride adjacent at least a portion of said intermediate layer.

2. The article as defined in claim 1 wherein said intermediate layer contains TiO.

3. The article as defined in claim 2 wherein said intermediate layer is less than or equal to approximately 1 micron in thickness.

4. An article as defined in any one of claims 1, 2 and 3 wherein said outer layer includes sub-layers of titanium nitride and titanium carbide, said titanium carbide sub-layer being disposed between and adjacent to said titanium nitride sub-layer and said intermediate layer.

5. An article comprising:
   (i) a cemented carbide or aluminum base solid ceramic substrate having aluminum oxide on at least portions of the surface thereof, said aluminum oxide forming a first surface;
   (ii) an intermediate layer of an oxide of titanium adjacent at least a portion of said first surface; and
   (iii) an outer layer of at least one of titanium nitride, titanium carbide and titanium carbonitride adjacent at least a portion of said intermediate layer, said outer layer further including sub-layers of titanium nitride and titanium carbide, said titanium carbide sub-layer being disposed between and adjacent to said titanium nitride sub-layer and said intermediate layer.

6. The article as defined in claim 5 wherein said intermediate layer contains TiO.

7. The article as defined in claim 6 wherein said intermediate layer is less than or equal to approximately one micron in thickness.

8. A process for coating at least portions of a cemented carbide or aluminum base solid ceramic substrate having aluminum oxide on at least portions of the surface thereof with an outer layer of at least one of titanium carbide, titanium nitride and titanium carbonitride, comprising:

depositing a layer of $TiO_2$ on said substrate adjacent said aluminum oxide by first heating said substrate, passing a gaseous mixture of hydrogen and titanium tetrachloride over the surface of said substrate, and finally introducing up to 15% by volume of $CO_2$ along with hydrogen and titanium tetrachloride;

reducing at least a portion of said $TiO_2$ to TiO to form an intermediate layer by passing only hydrogen and titanium tetrachloride over the surface of said substrate; and depositing said outer layer adjacent to said intermediate layer by introducing methane, nitrogen, or both, respectively, along with hydrogen and titanium tetrachloride.

9. The process as defined in claim 8 wherein said step of depositing a layer of $TiO_2$ includes heating said substrate at approximately 1050°–1100° C., passing a gaseous mixture of hydrogen and titanium tetrachloride over the surface of the substrate for 0–5 minutes, and introducing up to 15% by volume of $CO_2$ along with hydrogen and titanium tetrachloride for approximately 1–35 minutes.

10. The process as defined in claim 9 wherein the step of reducing includes passing only hydrogen and titanium tetrachloride over the surface of the substrate for a period of up to approximately 30 minutes at a temperature of about 1000° C.

11. The process as defined in claim 10 wherein the final step of depositing includes passing nitrogen, hydrogen and titanium tetrachloride over the surface of the substrate to form titanium nitride.

12. The process as defined in claim 10 wherein the final step of depositing includes passing methane, hydrogen and titanium tetrachloride over the surface of the substrate to produce titanium carbide.

13. The process as defined in claim 10 wherein the final step of depositing includes passing nitrogen, methane, hydrogen and titanium tetrachloride over the surface of the substrate to thereby produce titanium carbonitride.

* * * * *